United States Patent [19]

Parks et al.

[11] 3,936,693

[45] Feb. 3, 1976

[54] TWO-APERTURE IMMERSION LENS

[75] Inventors: Harold G. Parks; William C. Hughes, both of Scotia, N.Y.

[73] Assignee: General Electric Company, Schenectady, N.Y.

[22] Filed: May 8, 1974

[21] Appl. No.: 467,999

Related U.S. Application Data

[62] Division of Ser. No. 294,021, Oct. 2, 1972, abandoned.

[52] U.S. Cl. ..... 313/427; 313/429; 313/432

[51] Int. Cl.[2] ..... H01J 29/62; H01J 29/80

[58] Field of Search ..... 313/432, 441, 460, 437, 313/427

[56] References Cited

UNITED STATES PATENTS

| | | | |
|---|---|---|---|
| 2,452,919 | 11/1948 | Gabor | 313/460 X |
| 2,954,499 | 9/1960 | Gundert et al. | 313/432 X |
| 3,040,205 | 6/1962 | Walker | 313/432 X |
| 3,534,219 | 10/1970 | Newberry | 315/18 |
| 3,604,969 | 9/1971 | Blumenberg | 313/432 |

*Primary Examiner*—Robert Segal

*Attorney, Agent, or Firm*—Daniel R. Levinson; Joseph T. Cohen; Jerome C. Squillaro

[57] ABSTRACT

A two-aperture immersion lens comprising two substantially parallel plates having a plurality of optically aligned apertures therein is disclosed for an electron optical system. The spacing between the plates and the dimensions of the apertures are selected to provide spherical aberration characteristics which are substantially lower than those for the three-aperture Einzel lens. Also, higher beam current densities and longer cathode lifetimes are provided for electron beam systems by employing two-aperture immersion lenses.

5 Claims, 7 Drawing Figures

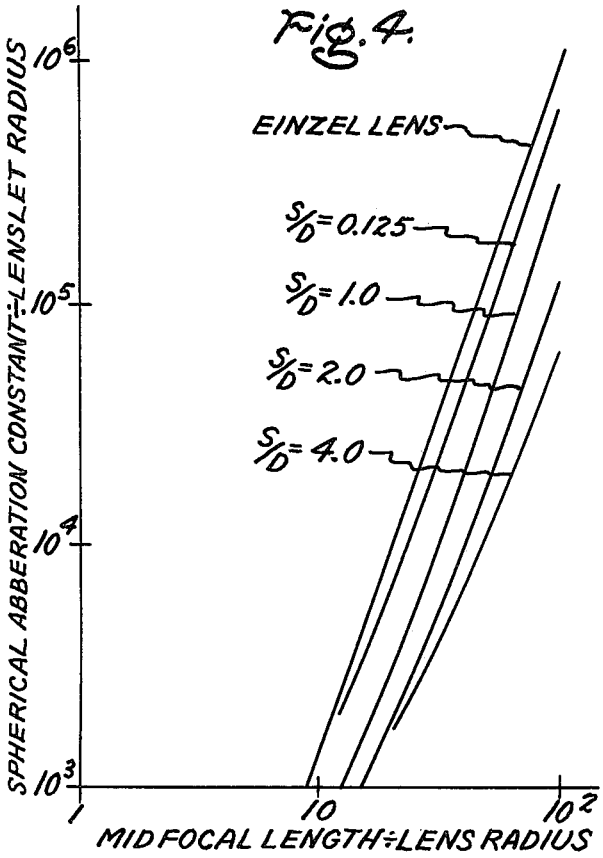
Fig. 4.
SPHERICAL ABBERATION CONSTANT÷LENSLET RADIUS
$10^6$
$10^5$
$10^4$
$10^3$
EINZEL LENS
S/D=0.125
S/D=1.0
S/D=2.0
S/D=4.0
1
10
$10^2$
MID FOCAL LENGTH÷LENS RADIUS

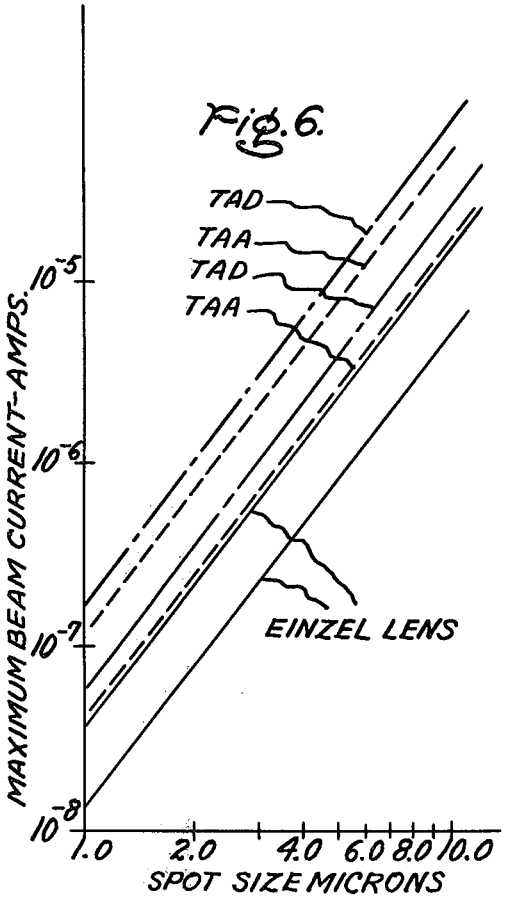
Fig. 6.
MAXIMUM BEAM CURRENT-AMPS.
$10^{-5}$
$10^{-6}$
$10^{-7}$
$10^{-8}$
TAD
TAA
TAD
TAA
EINZEL LENS
1.0
2.0
4.0
6.0
8.0
10.0
SPOT SIZE MICRONS

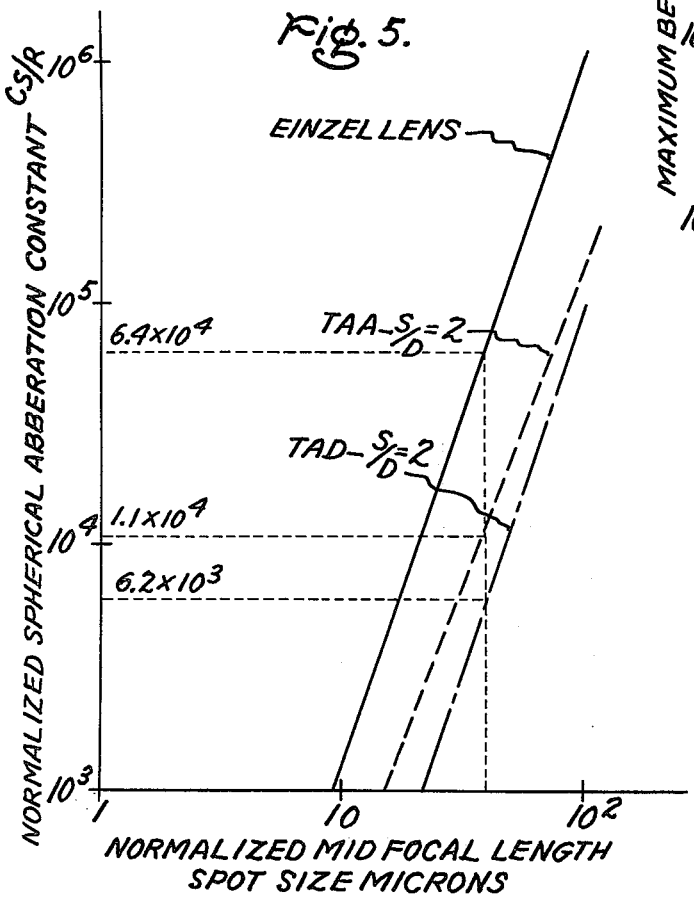
Fig. 5.
NORMALIZED SPHERICAL ABBERATION CONSTANT CS/R
$10^6$
$10^5$
$10^4$
$10^3$
EINZEL LENS
TAA-S/D=2
TAD-S/D=2
$6.4\times10^4$
$1.1\times10^4$
$6.2\times10^3$
1
10
$10^2$
NORMALIZED MID FOCAL LENGTH
SPOT SIZE MICRONS

TWO-APERTURE IMMERSION LENS

This is a division of application Ser. No. 294,021, filed Oct. 2, 1972, now abandoned.

The present invention relates to electron beam apparatus and methods and more particularly to an electron optical lens for controlling the point of impingement of an electron beam on a target surface.

Electron beam addressable memory systems have provided high capacity, random access memories of high storage density with rapid data storage and retrieval. These memory systems require precise control of an electron beam over the surface of a target structure. One such system which has been very useful is described in U.S. Pat. No. 3,534,219 — S. P. Newberry. This patent describes an electron optical system referred to generally as a Fly's Eye Lens because it is superficially similar in appearance to the compound eye of an ordinary housefly. In the Fly's Eye Lens system described by Newberry, an electron beam is directed to a receiving surface by first coarsely deflecting the beam in the general direction of a desired point of impingement on the receiving surface and then finely deflecting the beam toward the desired point of impingement so as to correct the path of the beam and then further deflecting the beam to the precise point of impingement. Apparatus utilized for this purpose includes a deflection system and a matrix of electron lenses for directing the electron beam to the desired point of impingement. The matrix of electron lenses is an electrostatic lens structure comprising three substantially parallel apertured plates. These apertured plates are biased so that the electron beam passing therethrough is focussed prior to passing through the fine deflection apparatus.

This three-element electrostatic lens structure is generally referred to as a three-aperture Einzel type lens system. While this lens system performs satisfactorily for many applications, the demands for higher density storage media impose more stringent requirements on this lens system than it is capable of achieving. Accordingly, to meet these needs an improved lens system is required.

It is therefore an object of this invention to provide a lens system having lower spherical aberration characteristics than heretofore achieved with the three-element Einzel type lens.

It is still a further object of this invention to provide a lens system having higher beam current densities than those achieved with the three-element Einzel lens.

It is yet another object of this invention to provide an electron lens system which lessens the requirements imposed on the coarse deflection system by approximately 50 percent.

It is still another object of this invention to provide a lens system which is more easily fabricated and aligned than the three-element lens system.

Briefly, in accord with our invention these and other objects are achieved by providing a two-aperture immersion-type lens comprising two substantially parallel plates having a plurality of aligned apertures therein with the spacing between the plates and the diameters of the apertures determining the electron optical characteristics of the lens. In further accord with our invention the two-aperture immersion lens provides an improvement in spherical aberration characteristics which is approximately a factor of five times better than those for the three-element Einzel lens when the two-aperture lens is utilized as an accelerating lens and an improvement in spherical aberration characteristics by a factor of ten when the lens is used for decelerating electrons.

The features of the invention believed to be novel are set forth with particularity in the appended claims. The invention itself, together with further objects and advantages thereof may be best understood by reference to the following description taken in conjunction with the accompanying drawings in which:

FIG. 4 is a plot of normalized spherical aberration constant versus normalized mid-focal length for the Einzel type lens and various two-aperture immersion-type lenses having different lens spacing to lens diameter ratios in accord with our invention;

FIG. 5 is a plot of normalized spherical aberration constant versus normalized mid-focal length for the Einzel type lens and a two-aperture immersion lens utilized to accelerate or decelerate an electron beam;

FIG. 6 is a plot of maximum beam current versus beam diameter for the Einzel and immersion type lenses.

Figure 1:
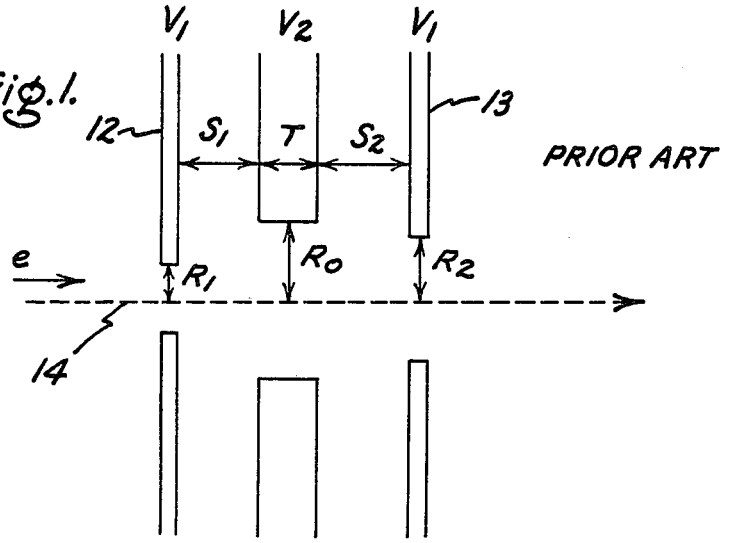
FIG. 1 is a simplified sectional view of a three-aperture Einzel type lens.

FIG. 1 illustrates a typical three-aperture Einzel lens constructed in accord with the prior art. The three-aperture Einzel lens includes an inner electrode 11 and two outer electrodes 12 and 13. The three electrodes each have an aperture therein through which an electron beam 14 may pass. The outer electrodes 12 and 13 of this lens are maintained at a potential $V_1$ with respect to the cathode of the electron beam system. Lens action is achieved by maintaining a separate potential, $V_2$, with respect to the cathode on the center element 11. The lens properties, i.e., focal lengths and aberrations, depend only on the aperture dimensions $R_1$, $R_2$ and $R_0$, the spacing between the plates $S_1$ and $S_2$, and T, the thickness of the plate 11, if $V_2 = 0$. In general, the Einzel type lens is operated with a variable potential for $V_2$ and the lens properties then depend on $V_2$ as well as the lens dimensions and spacing.

Various values for the element spacings and lenslet diameters may be used, depending upon the desired application. However, for purposes of illustration, a typical three-aperture Einzel lens, for example, has the following dimensions:

$S_1 = 0.030$ inches; $S_2 = 0.020$ inches;
$R_0 = 0.015$ inches; $R_1 = 0.0075$ inches; and
$T = 0.005$ inches.

Figure 2:
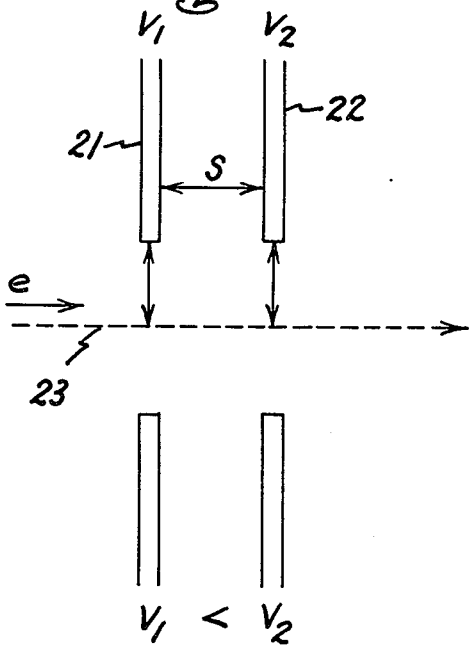
FIG. 2 is a simplified sectional view of one embodiment of a two-aperture accelerating immersion lens.

FIG. 2 illustrates an embodiment of our invention wherein a two-aperture immersion lens comprises a pair of substantially parallel lens plates 21 and 22 spaced apart from each other by a distance S and each having an aperture therein of radius $R_0$. The apertures in each of the plates 21 and 22 are aligned along the optical axis of an electron beam 23 which passes through these apertures before impinging on a receiving surface, as will be described more fully below. When voltages $V_1$ and $V_2$ are applied to plates 21 and 22, respectively, and $V_1$ is less than $V_2$, the two-aperture immersion lens accelerates the electrons passing therethrough. Hence, this lens is referred to as a two-aperture accelerating immersion lens (TAA).

Figure 3:
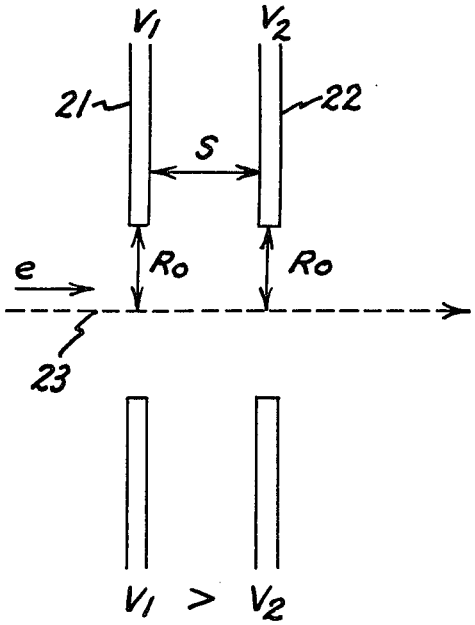
FIG. 3 is a sectional view of a two-aperture decelerating immersion lens.

FIG. 3 illustrates a two-aperture immersion lens similar to that described with reference to FIG. 2, however, the voltages $V_1$ and $V_2$ are adjusted so that $V_1$ is greater than $V_2$ and the electrons passing through the apertures are decelerated. This lens is referred to as a two-aperture decelerating immersion lens (TAD).

When using a two-aperture immersion lens for focussing an on-axis point source electron beam on a target surface, the most important performance limiting characteristic of the lens is the spherical aberration. Additionally, depending upon the type target structure employed, the landing potential of the electrons, the beam current and diameter of the beam at the target are also important requirements to be met. Additionally, it is desirable to achieve the beam current requirements with minimum cathode loading in order to maximize the cathode life. Additionally, in order to minimize extraneous effects on the beam, the overall tube dimensions including the cathode, condenser lens, deflection means, the two-aperture lens and the target structure should be no longer than necessary.

So that those skilled in the art may better understand the characteristics of a two-aperture immersion lens and the numerous advantages which result from the use of this lens, a typical electron beam addressable memory system utilizing a two-aperture immersion lens will be described. For example, assume that a particular target structure comprising a metal-oxide-semiconductor structure such as that described in patent application Ser. No. 125,133, filed Mar. 7, 1971, and of common assignee. An electron beam addressable memory employing such a target structure may, for example, require a beam landing potential, $V_L$, of 10,000 volts, a beam current, I, of 0.5 microamperes and a beam diameter, $d$, of 2.0 microns with 90 percent of the beam current I on the target. We have found that the maximum beam current for a given beam diameter on the target at a given brightness, $\beta_i$, and spherical aberration of the two-aperture immersion lens, $C_s$, is related in the following manner:

$$I_{max.} = (k_1 d)^{8/3} \beta_i / C_s^{2/3}$$

From this equation it can be seen that the spherical aberration constant $C_s$, should be as small as possible to get the most current from a source of given brightness. The spherical aberration constant for the two-aperture immersion lens depends on the lens dimensions (i.e., the aperture or lenslet diameter D and the spacing between the plates S) and the voltages applied to these plates. In considering the optical properties of the two-aperture immersion lens, various values of plate spacing to hole diameter, S/D, are considered.

FIG. 4 summarizes the information necessary to permit selection of lenslet dimensions. More specifically, FIG. 4 is a plot of normalized spherical aberration constant versus normalized mid-focal length for various S/D ratios. In each case, the spherical aberration constant is normalized with respect to lenslet radius and the midfocal length, $z_m$, which is the distance from the geometric lens center to the focal point of the electron beam, is also normalized with respect to lenslet radius. From FIG. 4 it can be seen that as S/D increases, $C_s/R$ decreases for a given value of $z_m/R$. Therefore, it is desirable to make S/D as large as possible. However, large values of S/D are extremely sensitive to external fields; hence, a useful compromise is a value of S/D = 2.0.

Also, in order to avoid field interactions between adjacent lenslets (or apertures), we have found that the maximum lenslet diameter must satisfy the following inequality: $D_{max.}$ $L/2$, where $L$ is the distance between adjacent lenslets. For a 16 × 16 matrix of lenslets on a 1 × 1 inch total field of view, the distance L is 60 mils. Hence, for a S/D ratio of 2.0, S should equal 60 mils.

For purposes of illustration, assume that the mid-focal length, $z_m$ is 600 mils. By normalizing this value of $z_m$ with respect to the lenslet radius, the optical properties and operating voltages are as follows:

TABLE I

| | |
|---|---|
| Plate separation to hole diameter ratio | S/D = 2.0 |
| Plate separation | S = 60 mils |
| Hole diameter | D = 30 mils |
| Accelerating ratio | V = 2.28 |
| Gun side plate potential | $V_1$ = 4.4 kV |
| Target side plate potential | $V_2$ = 10.0 kV |
| Field strength between plates | E = 3.7 × $10^4$V/cm |
| Normalized mid-focal length | $z_m$/R = 40.0 |
| Normalized spherical aberration const. | $C_s$/R = 1.1 × $10^4$ |
| Normalized chromatic aberration const | $C_c$/R = 125.0 |
| Mid-focal length | $z_m$ = 0.6 in. = 1.52 cm |
| Spherical aberration const | $C_s$ = 165 in. = 419.1 cm |
| Chromatic aberration const | $C_c$ = 1.875 in. = 4.75 cm |

From Table I, those skilled in the art can readily appreciate the numerous advantages of our invention over the three-element Einzel lens. For example, the accelerating ratio, V, which is equal to the ratio of the difference in potentials between $V_1$ and the cathode voltage, $V_k$, and the difference between $V_2$ and $V_k$ is 2.28 for the two-aperture immersion lens. Due to this accelerating factor, the beam energy in the coarse deflection region is about 4.4 KeV whereas with the Einzel lens it is 10 KeV. Therefore, the coarse deflection voltage for a two-aperture immersion lens system is only 0.44 of the coarse deflection voltage required for the Einzel lens system. Thus, in accord with our invention, substantially less coarse deflection drive is required than with the Einzel lens.

Still another advantage of our invention is the substantial reduction in spherical aberration over the Einzel lens. FIG. 5, for example, illustrates the normalized spherical aberration constant versus the normalized mid-focal length for a two-aperture immersion lens when employed as an accelerating lens (TAA) and as a decelerating lens(TAD). More specifically, FIG. 5 illustrates for a normalized mid-focal length of 40, the normalized spherical aberration constant for the Einzel lens is 6.4 × $10^4$ whereas for the two-aperture accelerating lens, it is only 1.1 × $10^4$ and for the two-aperture decelerating lens, it is only 6.2 × $10^3$. Hence, the two-aperture immersion lens has a lower spherical aberration than the Einzel lens by approximately a factor of five for the accelerating lenslet, TAA, and a factor of ten for the decelerating lenslet, TAD.

This reduction in spherical aberration of the immersion lenslets is more dramatically emphasized by considering beam current capabilities. As pointed out above, the maximum beam current, $I$, in a spot diameter, $d$, at a given beam brightness, $\beta_i$, and sperhical aberration of the lenslet, $C_s$, is given by $$I_{Max.} = (k_1 d)^{8/3} \beta_i / C_s^{2/3}$$

This equation assumes an optimum half angle of convergence, $\alpha$, of the beam at the target given by $$\alpha = \left(\frac{k2^d}{C_s}\right)^{1/3}$$

The quantities, $k_1$ and $k_2$, are dependent on the percentage of beam current in the spot, $d$. For 90 percent current profiles, $k_1$ and $k_2$ have the respective values of 1.3 and 0.9. Hence, in terms of maximum theoretical brightness at the image in amperes per centimeter$^2$ per steridian is given by $$\beta_T = j_o \frac{11{,}600}{\Pi T} V_L$$

where $j_o$ equals cathode loading (amp/centimeter$^2$), $T$ equals cathode temperature (°K), $V_L$ equals landing potential in volts. Electron sources or guns in practice do not fully produce this theoretical value of brightness and thus a more precise representation is given by $\beta_i = \gamma\beta_T$, where $\gamma$ is the gun efficiency. For high brightness sources, such as those employing a barium dispenser cathode, the efficiency, $\gamma$, may be as high as 80 percent. Table II illustrates the properties of typical barium dispenser cathodes at two different cathode loading conditions.

TABLE II

| ELECTRON GUN PARAMETERS | | | |
|---|---|---|---|
| $j_o$(amp/cm$^2$) | T (°C) | T (°K) | $\beta_i$ amp/cm$^2$/sr eq. 3 & 4 |
| 3 | 1080 | 1353 | 8.2 $\Gamma V_L$ |
| 10 | 1190 | 1463 | 25.0 $\Gamma V_L$ |

Using the gun brightness from Table II and assuming the operating point illustrated in FIG. 5, the maximum beam current as calculated from the foregoing equation with $\gamma = 0.8$ and $V_L = 8000$ volts, the results are illustrated graphically in FIG. 6. From FIG. 6 it can be seen that a 3 A/cm$^2$ cathode with the two-aperture immersion lens outperforms a 10 A/cm$^2$ cathode with the Einzel lens. This is a significant factor in terms of gun lifetimes. For example, cathode lifetimes roughly double for every 50°C. reduction in cathode temperature. From Table II it can be seen that this represents a factor of four times greater gun lifetime for the two-aperture immersion lens as opposed to the Einzel lens. Hence, by employing the two-aperture immersion lens, higher current capabilities and longer cathode lifetimes are achieved.

Figure 7:
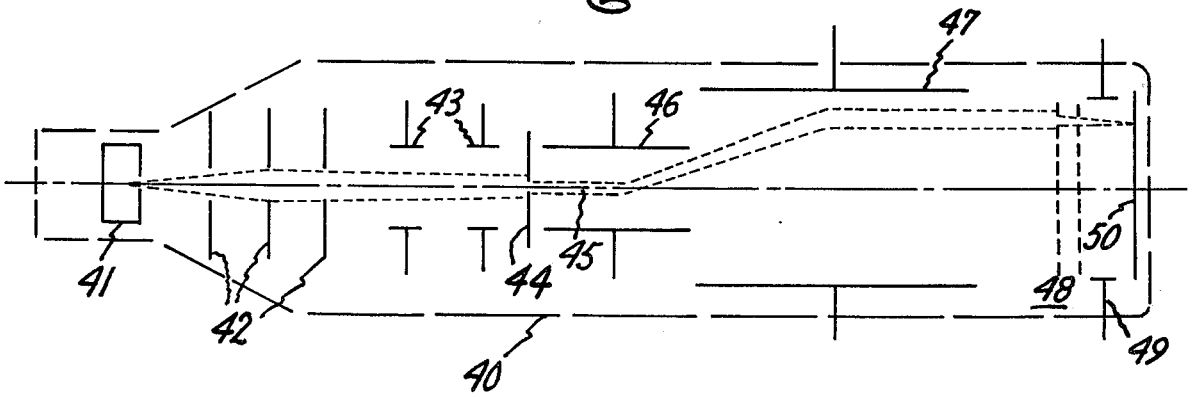
FIG. 7 is a schematic illustration of an electron beam addressable target employing a two-aperture immersion-type lens in accord with our invention.

So that those skilled in the art can better appreciate the usefulness of the two-element immersion lens constructed in accord with our invention, reference is made to FIG. 7 which illustrates a typical electron beam addressable memory system employing a two-aperture immersion lens. More specifically, FIG. 7 illustrates an evacuated enclosure 40 including a source of electrons 41 such as a barium dispenser cathode, for example. The electrons emitted from the cathode pass through a condenser lens comprising a plurality of apertured plates 42 and then through electrostatic steering plates 43 which direct the electron beam through an apertured plate 44 for producing an electron beam 45 of controlled divergence angle. The electron beam 45 is then deflected from the center axis of the electron optical system by a course deflection assembly 46 to a second larger deflection assembly 47 which deflects the electron beam in an opposite direction from the deflection assembly 46 so that the electron beam enters a selected lenslet of the two-aperture immersion lens 48.

The two-aperture immersion lens 48 may, for example, comprise an array of 16 × 16 lenslets. Each lenslet in turn has its own fine deflection lens associated therewith. This fine deflection lens is illustrated schematically in FIG. 7 by the plates 49. However, the aforementioned patent to Newberry describes a suitable fine deflection assembly comprising a plurality of interdigitated horizontal and vertical deflection bars which electrostatically deflect the electron beam exiting from each lenslet of the two-aperture immersion lens to a specific point of impingement on the target structure 50. Typically, the fine deflection assembly is capable of deflecting an electron beam over the surface of the target encompassed by a 10° cone.

Operationally, whenever it is desired to read or write data on the storage target 50, the electron beam 45 is turned on and deflected into the region enclosed by the coarse deflection assemblies 46 and 47 and then to a specific lenslet in the two-aperture immersion lens 48. This deflection, may, for example, be controlled by voltages from a digital to analog converter in response to signals furnished by a computer.

The electron beam is then focussed by passage through the two-aperture immersion lens and enters the fine deflection region under the control of the fine deflection assembly 49. Deflection of the electron beam within this region is again controlled, for example, by digital to analog converters in response to output signals from the computer. The electron beam is then directed to a specific storage site on the target structure 50.

Readout from the target structure, obviously depends upon the particular target employed, but, in general, the passage of an electron beam across the storage region produces a measurable output electrical signal which may then be utilized for data processing purposes.

From the above description, it can be readily appreciated that the present invention provides a new and improved electron optical lens which is characterized by improved spherical aberration characteristics and permits higher beam current densities and increased cathode lifetimes than those achievable with prior art Einzel lens.

While only certain preferred features of the invention have been shown by way of illustration, many modifications and changes will occur to those skilled in the art. For example, although the apertures in the lens plates are illustrated to be of equal diameter, the dimensions may in fact be different, if desired. In some instances, where the apertures in the lens plate closer to the target structure are larger than the apertures in the other lens plates, still further decreases in spherical aberration are achieved. It is therefore to be understood that the appended claims are intended to cover all such modifications and changes as fall within the true spirit and scope of the invention.

What we claim as new and desire to secure by Letters Patent of the United States is:

1. In an electron beam optical system including a source of electrons, coarse deflection means for directing said electrons toward an electron focussing means in the form of an electron beam, and means for focussing said beam on a target, the improvement comprising:

said focussing means consisting solely of a pair of substantially parallel plates spaced apart from each other and positioned between all of said coarse deflection means and said target, each plate having a plurality of substantially circular apertures therein with said apertures in each plate aligned along the optical axis of said electrom beam so as to form a matrix of lenslets, and means for biassing said plates to cause electrons passing through said apertures to be accelerated or decelerated before impinging on said target;

said coarse deflection means comprising a first assembly for deflecting the electron beam from said source from the center axis of the electron optical system, and a second assembly for deflecting the deflected electron beam in an opposite direction to cause the twice deflected electron beam to enter a selected lenslet of said matrix.

2. The combination of claim 1 wherein the electron beam entering an aperture in the plate closer to said source of electrons is substantially orthogonal to said plate.

3. The combination of claim 1 further comprising fine deflection means positioned between said target structure and the plate closer to said target structure, said fine deflection means deflecting the electron beam exiting from the aperture in said plate to a precise point on said target structure.

4. The combination of claim 1 wherein the spacing between said parallel plates, S, and the diameter of the apertures in said plates, D, are of such value that the ratio thereof, S/D is substantially above zero but no greater than 4.

5. The combination of claim 4 wherein said ratio, S/D, is about 2.

* * * * *